United States Patent [19]

Huie

[11] 3,933,151

[45] Jan. 20, 1976

[54] DEVICE FOR MASSAGING A FINGER

[76] Inventor: Joe Huie, 122 E. 5th St., Duluth, Minn. 55805

[22] Filed: Dec. 12, 1974

[21] Appl. No.: 532,020

[52] U.S. Cl. ..... 128/52; 128/26

[51] Int. Cl.[2] ..... A61H 7/00

[58] Field of Search ..... 128/26, 55, 59, 51, 52, 128/24.2

[56] References Cited

UNITED STATES PATENTS 2,148,661 2/1939 Thierer ..... 128/24.2

*Primary Examiner*—Lawrence W. Trapp

*Attorney, Agent, or Firm*—Wicks & Nemer

[57] ABSTRACT

A device for massaging a finger including a main support with an operable reciprocating member thereon together with an upper resilient pad mounted on the main support for reciprocal movement by the reciprocating member. A pair of springs normally urging the upper pad against reciprocation together with a lower stationary resilient pad in alignment with the upper pad and on which a finger is placed for intermittent contact with said upper pad in its reciprocating action.

2 Claims, 3 Drawing Figures

DEVICE FOR MASSAGING A FINGER

SUMMARY

The invention relates generally to a massage device and more particularly to a device for massaging a finger and with particular reference to massaging the knuckles of a victim of arthritis whereby the size and the ache of the knuckles may be reduced.

The device includes a stationary resilient pad and a reciprocating resilient pad which moves to and from the stationary pad in quick succession in spaced relation and contacting a finger placed upon the stationary pad thereby massaging the finger.

In the drawings forming part of this application:

Figure 1:
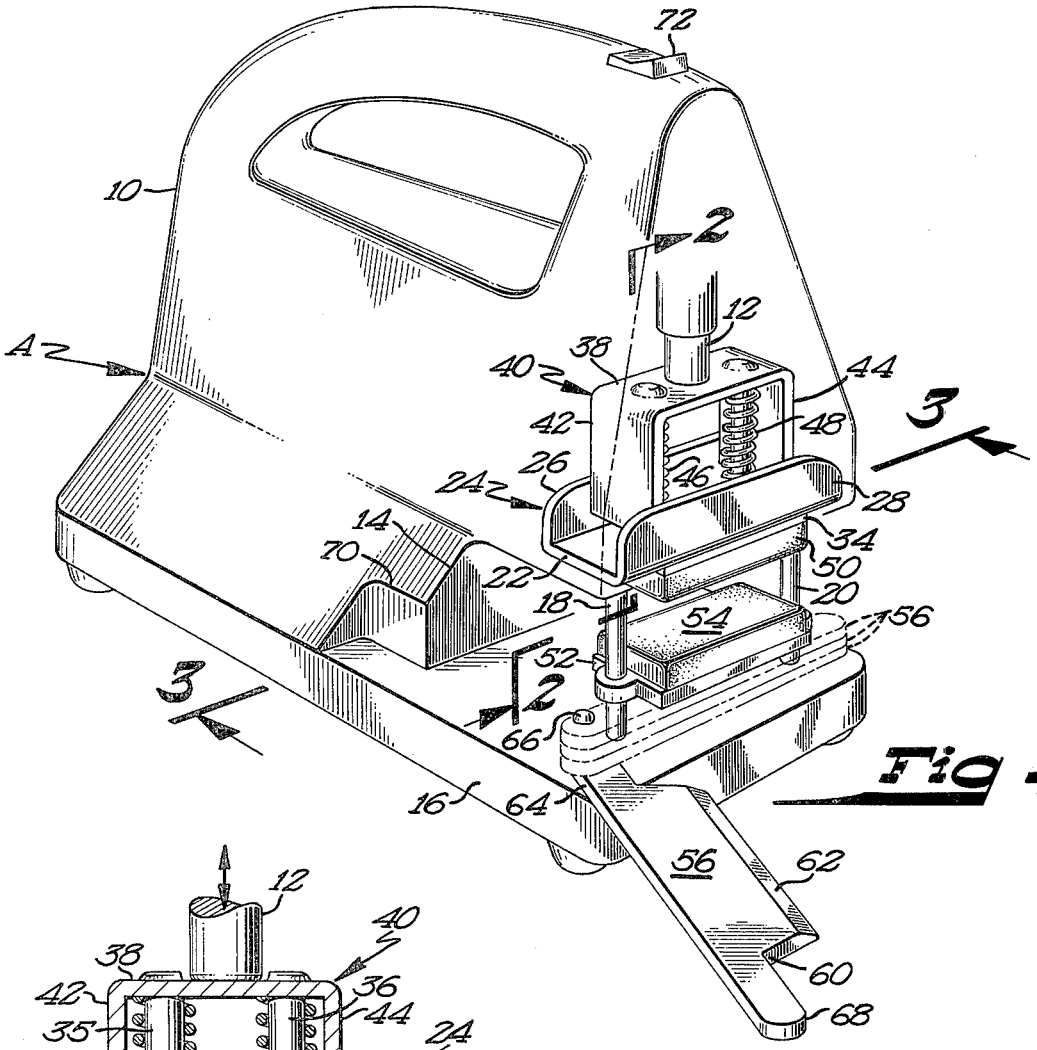
FIG. 1 is a perspective view of a device for massaging fingers and the knuckles thereof embodying the invention.
Figure 3:
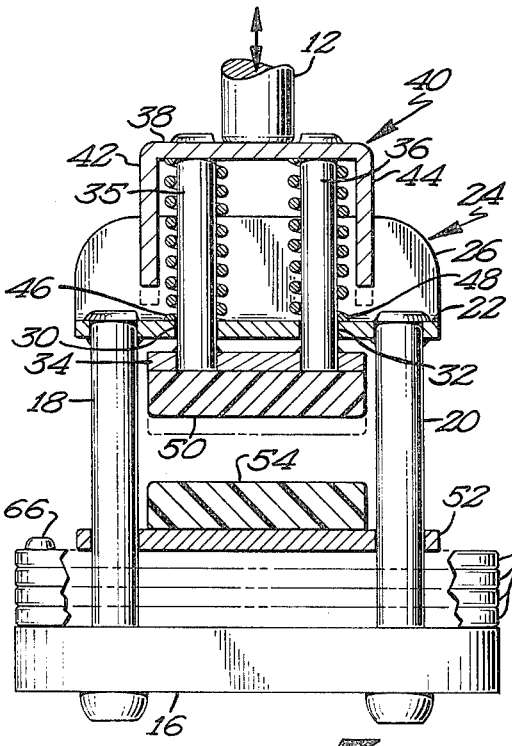
FIG. 3 is a sectional view on the line 3—3 of FIG. 1.
Figure 2:
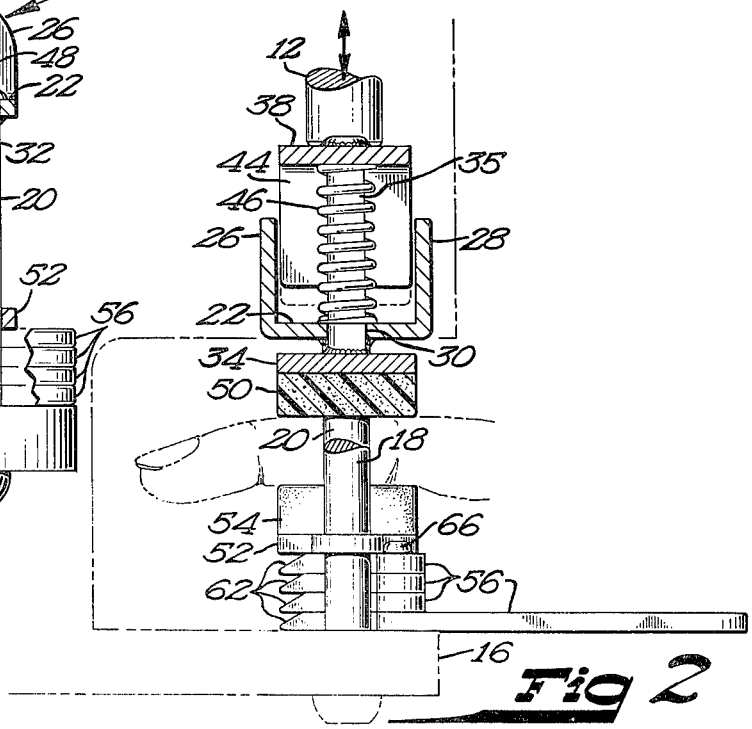
FIG. 2 is a sectional view on the line 2—2 of FIG. 1.

Referring to the drawings in detail, the massaging device A includes the body housing 10 which houses a mechanism having the reciprocating member 12 as found in a conventional sabre saw such as "Master Craft", model 105107, manufactured by Master Craft Engineering, Inc. of Minneapolis, Minn. The number of strokes per minute of the member 12 has been found to be preferrable at 900–1200. The housing body 10 includes the recess 14 which produces the base portion 16 underlying the upper portion of the body 10.

Secured to the base portion 16 are the spaced uprights 18 and 20, and secured to the upper ends of the uprights is the base portion 22 of the U-shaped platform support 24. Extending upwardly from the cross bar portion 22 are the side portions 26 and 28. The base portion 22 of support 24 has formed therethrough the spaced holes 30 and 32 which are in the same plane as the supports 18 and 20. The numeral 34 designates a plate and secured to the upper surface of the plate are the spaced guide rods 34 and 36 which extend through the holes 30 and 32, respectively. Secured to the top ends of the rods 35 and 36 is the base portion 38 of the U-shaped support 40, the base portion formed with the depending legs 42 and 44. The length of the legs 42 and 44 is such that the extent of downward movement of the upper pad hereinafter mentioned is limited to contact of the legs with the base 22 as a safety feature whereby the finger cannot be harmed if there is a malfunction of the member 12.

Mounted on the rods 34 and 36 and interposed between the base portion 38 of support 40 and cross bar 22 are the coil springs 46 and 48, respectively. The springs 46 and 48 normally urge the support 40 upwardly against the reciprocating member 12. The plate 34 has secured to the underside thereof the flat relilient member in the form of rubber pad 50.

The numeral 52 designates a plate which has formed therethrough the holes 54 and 56 through which the uprights 18 and 20 freely extend. Mounted in the top of the plate 52 is the flat resilient member in the form of the rubber pad 54 which is in vertical alignment with the rubber pad 50. The plate 52 is slidable up and down on the supports 18 and 20, and positioned under the plate 52 is one or more removable plates 56. Each plate 56 is formed with the first notch 58 at one end and a second notch 60 at the other end, and the plate edge portion between the notches is bevelled as at 62 to facilitate entry of one plate between the other plates. The end 64 of each plate is formed with a hole which receives the mounting pin 66 secured at its lower end in the base portion 16 for pivotal movement of the plates to the position shown in broken lines in FIG. 1 and retracted to a position with the end portion 68 of the blade within the recess 70 for out of the way storage.

With a plate or plates 56 selectively positioned beneath the plate 52 the distance between the pads 50 and 54 may be adjusted when the reciprocating movement of the pad 50 is at its lowest point to accommodate fingers and knuckles thereof of different sizes. The device A is provided with the conventional switch 72 which actuates the machanism which operates the reciprocating member 12. The member 12 contacts and moves downwardly the support 40 which in turn moves the pad 50 downwardly towards the pad 54, but due to the thickness of the pads 50 and 54 and the length of the stroke of the member 12, the pad 50 in its downward stroke stops short of the pad 54 for massaging of a knuckle or finger placed between the pads with only the desired amount of pressure of the reciprocating pad 50 upon the finger placed on the pad 54. With the rapid intermittent pressure of the pad 50 upon a finger upon the pad 54 a massaging effect upon the finger or knuckle is accomplished with particular benefit to arthritis victims.

I claim:

1. A device for massaging a finger comprising:

a. a main support, b. an operable reciprocating member mounted on said main support, c. an upper resilient pad, d. means mounting said upper pad on said main support for reciprocal movement by said reciprocating member, e. means normally urging said upper pad against reciprocation, f. a lower resilient pad carried by said main support, g. means mounting said lower resilient pad on said support in alignment with said upper pad on which a finger is supported for intermittent contact with said upper pad in its reciprocating action, h. means for adjustably positioning said lower pad relative to said upper pad, said adjustable means including:

i. at least one plate and j. means for removably positioning said plate between said lower pad and said main support.

2. A device for massaging a finger comprising:

a. a main support, b. an operable reciprocating member mounted on said main support, c. an upper resilient pad, d. an upper support having e. a pair of spaced rods connected to and dependent therefrom, f. a platform, g. a pair of spaced rods mounting said platform on said main support h. said platform having openings therein and through which said rods of said upper support extend, i. said upper pad connected to the lower ends of said rods of said upper support in alignment with j. a lower pad slidably mounted on said rods mounting said platform.

* * * * *